US010053919B2

(12) United States Patent
Kolbe et al.

(10) Patent No.: US 10,053,919 B2
(45) Date of Patent: Aug. 21, 2018

(54) MOVEABLE ELEMENT TO CREATE PRESSURE SIGNALS IN A FLUIDIC MODULATOR

(71) Applicant: Schlumberger Technology Corporation, Sugar land, TX (US)

(72) Inventors: Stuart Alan Kolbe, North Somerset (GB); Jonathan James, Gloucester (GB); Christopher Paul Reed, Houston, TX (US); David Kirk Conn, Houston, TX (US)

(73) Assignee: SCHLUMBERGER TECHNOLOGY CORPORATION, Sugar Land, TX (US)

( * ) Notice: Subject to any disclaimer, the term of this patent is extended or adjusted under 35 U.S.C. 154(b) by 695 days.

(21) Appl. No.: 14/445,063

(22) Filed: Jul. 29, 2014

(65) Prior Publication Data

US 2015/0034385 A1 Feb. 5, 2015

Related U.S. Application Data

(60) Provisional application No. 61/860,206, filed on Jul. 30, 2013, provisional application No. 61/913,347, filed on Dec. 8, 2013, provisional application No. 62/002,901, filed on May 25, 2014, provisional application No. 62/002,904, filed on May 25, 2014.

(51) Int. Cl.

| | |
|---|---|
| ***E21B 34/10*** | (2006.01) |
| ***E21B 17/00*** | (2006.01) |
| ***E21B 47/12*** | (2012.01) |
| ***E21B 47/18*** | (2012.01) |

(52) U.S. Cl.
CPC ..... *E21B 17/006* (2013.01); *E21B 34/10* (2013.01); *E21B 47/12* (2013.01); *E21B 47/185* (2013.01); *Y10T 137/0318* (2015.04)

(58) Field of Classification Search
CPC ..... E21B 17/006; E21B 34/10; E21B 47/12; E21B 47/185; Y10T 137/0318
See application file for complete search history.

(56) References Cited

U.S. PATENT DOCUMENTS

| | | | |
|---|---|---|---|
| 2,918,933 | A | 12/1959 | Boitnott |
| 3,309,656 | A | 3/1967 | Godbey |
| 4,033,429 | A | 7/1977 | Farr |

(Continued)

FOREIGN PATENT DOCUMENTS

| | | | |
|---|---|---|---|
| CN | 86105519 | A | 2/1988 |
| EP | 0584998 | | 3/1994 |
| SU | 1490268 | A1 | 6/1989 |

OTHER PUBLICATIONS

International search report and written opinion for the relevant PCT patent application No. PCT/US2014/048827 dated Nov. 12, 2014.

(Continued)

*Primary Examiner* — Daniel P Stephenson

(57) ABSTRACT

A fluidic modulator in accordance to an aspect includes a body forming a flow aperture between an inlet and an outlet, the flow aperture providing a constriction to a fluid flowing axially from the inlet to the outlet, and a moveable element having a shaft portion disposed through the body and a tip end selectively positionable in the flow aperture to alter the flow aperture.

18 Claims, 12 Drawing Sheets

(56) References Cited

U.S. PATENT DOCUMENTS

| | | | | |
|---|---|---|---|---|
| 4,825,747 | A | 5/1989 | Bardin et al. | |
| 4,847,815 | A | 7/1989 | Malone | |
| 4,979,577 | A | 12/1990 | Walter | |
| 5,215,152 | A | 6/1993 | Duckworth | |
| 5,375,098 | A | 12/1994 | Malone et al. | |
| 5,740,127 | A | 4/1998 | Van Steenwyk et al. | |
| 5,787,052 | A | 7/1998 | Gardner et al. | |
| 5,802,011 | A | 9/1998 | Winters et al. | |
| 6,053,261 | A | 4/2000 | Walter | |
| 6,094,401 | A | 7/2000 | Masak et al. | |
| 6,227,547 | B1 * | 5/2001 | Dietle | E21B 4/003 277/336 |
| 6,237,701 | B1 | 5/2001 | Kolle et al. | |
| 6,279,670 | B1 | 8/2001 | Eddison et al. | |
| 6,394,221 | B2 | 5/2002 | Cosma | |
| 6,431,294 | B1 | 8/2002 | Eddison et al. | |
| 6,508,317 | B2 | 1/2003 | Eddison et al. | |
| 6,626,253 | B2 | 9/2003 | Hahn et al. | |
| 6,970,398 | B2 | 11/2005 | Lavrut et al. | |
| 7,114,579 | B2 | 10/2006 | Hutchinson | |
| 7,139,219 | B2 | 11/2006 | Korre et al. | |
| 7,327,634 | B2 | 2/2008 | Perry et al. | |
| 7,982,464 | B2 | 7/2011 | Bittar et al. | |
| 8,272,404 | B2 | 9/2012 | Brunskill et al. | |
| 8,302,685 | B2 | 11/2012 | Reyes et al. | |
| 2004/0069530 | A1 | 4/2004 | Prain et al. | |
| 2009/0034368 | A1 * | 2/2009 | Johnson | E21B 47/14 367/83 |
| 2010/0230113 | A1 | 9/2010 | Hutin et al. | |
| 2012/0132289 | A1 | 5/2012 | Kolle | |
| 2013/0092246 | A1 | 4/2013 | Kolle | |
| 2013/0162440 | A1 | 6/2013 | Parry et al. | |
| 2015/0034165 | A1 * | 2/2015 | Conn | E21B 17/006 137/1 |
| 2015/0034385 | A1 * | 2/2015 | Kolbe | E21B 17/006 175/48 |
| 2015/0034386 | A1 * | 2/2015 | Reed | E21B 17/006 175/48 |
| 2016/0298418 | A1 * | 10/2016 | James | E21B 34/066 |

OTHER PUBLICATIONS

International search report and written opinion for the equivalent PCT patent application No. PCT/US2014/048844 dated Nov. 13, 2014.

First Office Action and Search Report issued in Chinese patent application 201480053680.1 dated May 16, 2017. 22 pages.

Office action and Search Report issued in Russian patent application 2016106638 dated Feb. 20, 2017.

International Preliminary Report on Patentability issued in International Patent application PCT/US2014/048844, dated Feb. 11, 2016. 12 pages.

International Search Report and Written Opinion issued in International Patent application PCT/US2014/048864, dated Nov. 28, 2014. 14 pages.

International Preliminary Report on Patentability issued in International Patent application PCT/US2014/048864, dated Feb. 11, 2016. 11 pages.

International Preliminary Report on Patentability issued in International Patent application PCT/US2014/048827, dated Feb. 11, 2016. 12 pages.

Office Action issued in U.S. Appl. No. 14/445,064 dated Mar. 31, 2017. 8 pages.

Office Action issued in U.S. Appl. No. 14/445,062 dated Apr. 14, 2016. 17 pages.

Office Action issued in U.S. Appl. No. 14/445,062 dated Dec. 9, 2016. 24 pages.

* cited by examiner

MOVEABLE ELEMENT TO CREATE PRESSURE SIGNALS IN A FLUIDIC MODULATOR

BACKGROUND

This section provides background information to facilitate a better understanding of the various aspects of the disclosure. It should be understood that the statements in this section of this document are to be read in this light, and not as admissions of prior art.

Wells are generally drilled into the ground to recover natural deposits of hydrocarbons and other desirable materials trapped in geological formations in the Earths crust. A well is typically drilled using a drill bit attached to the lower end of a drill string. The well is drilled so that it penetrates the subsurface formations containing the trapped materials and the materials can be recovered.

At the bottom end of the drill string is a bottom hole assembly ("BHA"). The BHA includes the drill bit along with sensors, control mechanisms, and the required circuitry. A typical BHA includes sensors that measure various properties of the formation and of the fluid that is contained in the formation. A BHA may also include sensors that measure the BHA's orientation and position.

The drilling operations may be controlled by an operator at the surface or operators at a remote operations support center. The drill string is rotated at a desired rate by a rotary table, or top drive, at the surface, and the operator controls the weight-on-bit and other operating parameters of the drilling process.

Another aspect of drilling and well control relates to the drilling fluid, called mud. The mud is a fluid that is pumped from the surface to the drill bit by way of the drill string. The mud serves to cool and lubricate the drill bit, and it carries the drill cuttings back to the surface. The density of the mud is carefully controlled to maintain the hydrostatic pressure in the borehole at desired levels.

In order for the operator to be aware of the measurements made by the sensors in the BHA, and for the operator to be able to control the direction of the drill bit, communication between the operator at the surface and the BHA are necessary. A downlink is a communication from the surface to the BHA. Based on the data collected by the sensors in the BHA, an operator may desire to send a command to the BHA. A common command is an instruction for the BHA to change the direction of drilling.

Likewise, an uplink is a communication from the BHA to the surface. An uplink is typically a transmission of the data collected by the sensors in the BHA. For example, it is often important for an operator to know the BHA orientation. Thus, the orientation data collected by sensors in the BHA is often transmitted to the surface. Uplink communications are also used to confirm that a downlink command was correctly understood.

One common method of communication is called mud pulse telemetry. Mud pulse telemetry is a method of sending signals, either downlinks or uplinks, by creating pressure and/or flow rate pulses in the mud. These pulses may be detected by sensors at the receiving location. For example, in a downlink operation, a change in the pressure or the flow rate of the mud being pumped down the drill string may be detected by a sensor in the BHA. The pattern of the pulses, such as the frequency, the phase, and the amplitude, may be detected by the sensors and interpreted so that the command may be understood by the BHA.

One method of mud pulse telemetry is disclosed in U.S. Pat. No. 3,309,656, comprises a rotary valve or "mud siren" pressure pulse generator which repeatedly interrupts the flow of the drilling fluid, and thus causes varying pressure waves to be generated in the drilling fluid at a carrier frequency that is proportional to the rate of interruption. Downhole sensor response data is transmitted to the surface of the earth by modulating the acoustic carrier frequency. A related design is that of the oscillating valve, as disclosed in U.S. Pat. No. 6,626,253, wherein the rotor oscillates relative to the stator, changing directions every 180 degrees, repeatedly interrupting the flow of the drilling fluid and causing varying pressure waves to be generated. Some pulse generating valves are subject to jamming and erosion, given the nature of moving parts, and some have power consumption levels that are limiting in a downhole environment.

SUMMARY

In accordance to an aspect of the disclosure a fluidic modulator includes a moveable element disposed through a diamond bearing surface into a constricted flow aperture. The moveable element may for example be linearly translated through the bearing surface into the flow aperture, circumferentially rotated into the flow aperture, and or rotated in the flow aperture. In accordance to aspects of the disclosure, a moveable element to create a pressure signals in a venturi includes a shaft and a tab or tip end. The shaft and the tip end may be formed of different materials of construction, for example the shaft may be constructed of diamond and the tip end of tungsten carbide. A fluidic modulator in accordance to an aspect includes a body forming a flow aperture between an inlet and an outlet, the flow aperture providing a constriction to a fluid flowing axially from the inlet to the outlet, and a moveable element having a shaft portion disposed through the body and a tip end selectively positionable in the flow aperture to alter the flow aperture.

This summary is provided to introduce a selection of concepts that are further described below in the detailed description. This summary is not intended to identify key or essential features of the claimed subject matter, nor is it intended to be used as an aid in limiting the scope of claimed subject matter.

BRIEF DESCRIPTION OF THE DRAWINGS

Embodiments of fluid modulator devices, systems and methods are described with reference to the following figures. The same numbers are used throughout the figures to reference like features and components. It is emphasized that, in accordance with standard practice in the industry, various features are not necessarily drawn to scale. In fact, the dimensions of various features may be arbitrarily increased or reduced for clarity of discussion.

DETAILED DESCRIPTION

Figure 1:
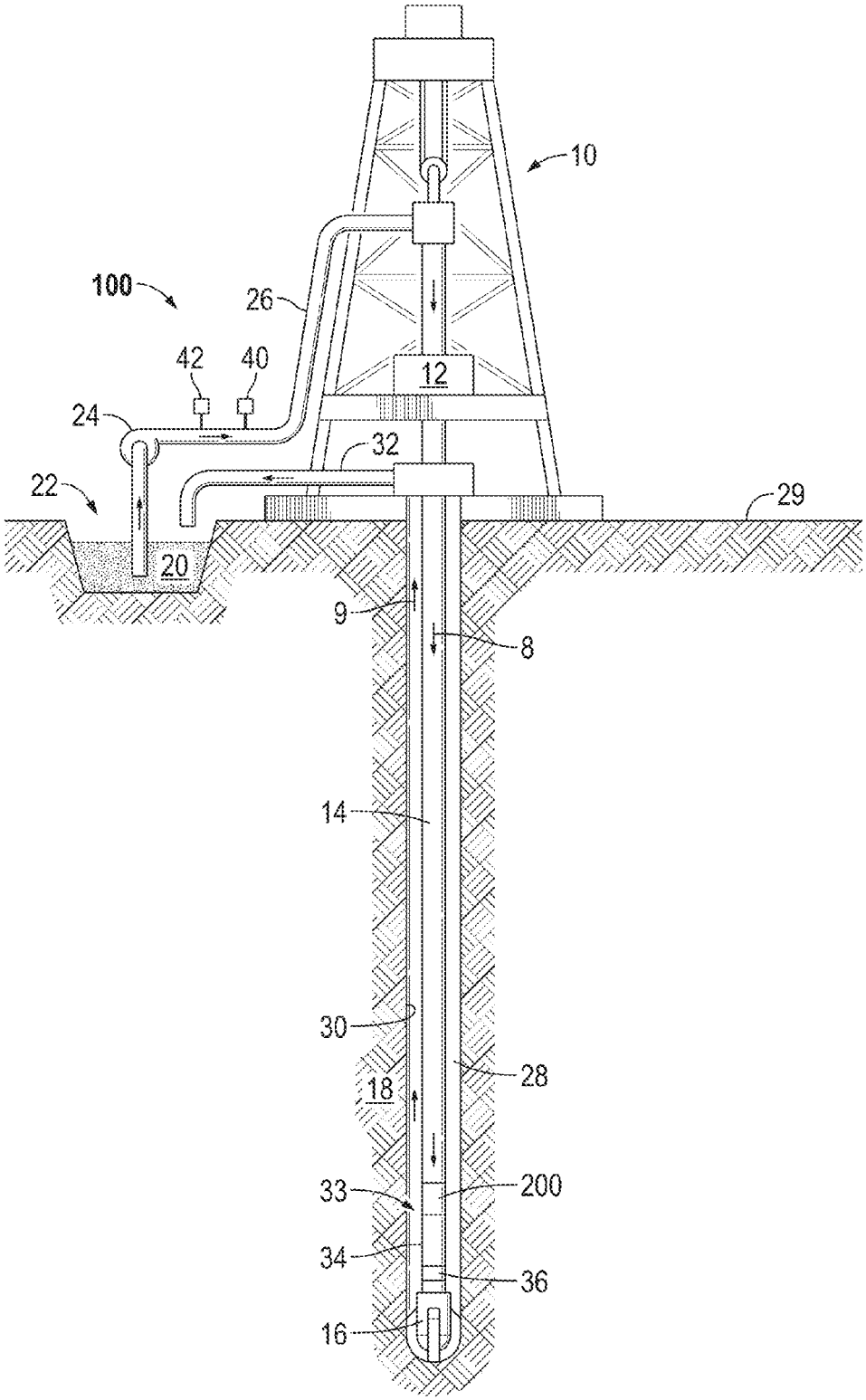
FIGS. 1, 2, and 20 are schematic illustrations of well systems in which fluidic modulators in accordance to aspects of the disclosure can be implemented.

It is to be understood that the following disclosure provides many different embodiments, or examples, for implementing different features of various embodiments. Specific examples of components and arrangements are described below to simplify the disclosure. These are, of course, merely examples and are not intended to be limiting. In addition, the disclosure may repeat reference numerals and/or letters in the various examples. This repetition is for the purpose of simplicity and clarity and does not in itself dictate a relationship between the various embodiments and/or configurations discussed.

Fluidic modulators, systems, and methods disclosed herein may provide lower power consumption than current devices, a wider operating range than current devices, the capability to isolate the surface receiver from drilling and mud motor noise, the capability to isolate surface rig and mud pump noise from the downhole receivers and transmitters, provide the ability to perform fishing operations through the modulation device which is substantially coaxial with the drill string, and provides amplitude control (e.g., amplitude magnitude and/or quadrature amplitude modulation ("QAM") control of the mud pulse signal. In accordance to aspects the fluidic modulator permits the use of high bandwidth efficiencies such as QAM. The fluidic modulator provides dynamic gapping control. For example, the disclosed fluidic modulators may permit the gap setting to be changed while the fluidic modulator is located downhole in order to change the generated signal strength to accommodate changes in the mud flow rate. In accordance to aspects of the disclosure the fluidic modulators are capable of phase, frequency, amplitude, or any combination of those, single-carrier or multi-carrier modulation, using a wide range of frequencies. The disclosed fluidic modulators can utilize these modulations when they function for example as uplink, downlink or along the string measurement or repeater tools.

FIG. 1 schematically illustrates a well or drilling system 100, which may be on-shore or off-shore, in which fluidic modulators 200 in accordance to this disclosure may be implemented. System 100 is depicted having a drilling rig 10 which includes a drive mechanism 12 to provide a driving torque to a drill string 14. The lower end of the drill string 14 extends into a wellbore 30 and carries a drill bit 16 to drill an underground formation 18. During drilling operations, drilling fluid 20 is drawn from a mud pit 22 at a surface 29 via one or more pumps 24, such as, for example, one or more reciprocating pumps. The drilling fluid 20 is circulated through a mud line 26 down through the drill string 14, through the drill bit 16, and back to the surface 29 via an annulus 28 between the drill string 14 and the wall of the wellbore 30. Upon reaching the surface 29, the drilling fluid 20 is discharged through a line 32 into the mud pit 22 so that drill cuttings, such as, for example, rock and/or other well debris carried uphole in the drilling mud can settle to the bottom of the mud pit 22 before the drilling fluid 20 is recirculated into the drill string 14.

Depicted drill string 14 includes a bottom hole assembly ("BHA") 33, which includes at least one downhole tool 34. Downhole tool 34 may comprise survey or measurement tools, such as, logging-while-drilling ("LWD") tools, measuring-while-drilling ("MWD") tools, near-bit tools, on-bit tools, and/or wireline configurable tools. LWD tools may include capabilities for measuring, processing, and storing information, as well as for communicating with surface equipment. Additionally, LWD tools may include one or more of the following types of logging devices that measure characteristics associated with the formation 18 and/or the wellbore: a resistivity measuring device; a directional resistivity measuring device; a sonic measuring device; a nuclear measuring device; a nuclear magnetic resonance measuring device; a pressure measuring device; a seismic measuring device; an imaging device; a formation sampling device; a natural gamma ray device; a density and photoelectric index device; a neutron porosity device; and a borehole caliper device. A LWD tool is identified specifically with the reference number 120 in FIG. 2.

MWD tools may include for example one or more devices for measuring characteristics adjacent drill bit 16. MWD tools may include one or more of the following types of measuring devices: a weight-on-bit measuring device; a torque measuring device; a vibration measuring device; a shock measuring device; a stick slip measuring device; a direction measuring device; an inclination measuring device; a natural gamma ray device; a directional survey device; a tool face device; a borehole pressure device; and a temperature device. MWD tools may detect, collect and/or log data and/or information about the conditions at the drill bit 16, around the underground formation 18, at a front of the drill string 14 and/or at a distance around the drill strings 14. A MWD tool is identified with the reference number 130 in FIG. 2.

Downhole tool 34 may comprise a downhole power source, for example, a battery, downhole motor, turbine, a downhole mud motor or any other power generating source. The power source may produce and generate electrical power or electrical energy to be distributed throughout the BHA 33 and/or to power the at least one downhole tool 34.

Depicted downhole tool 34 includes a sensor 36, e.g., sensor assembly, data source, and a fluidic modulator 200 for mud pulse telemetry in accordance to one or more aspects of this disclosure. Fluidic modulator 200 is operated to disrupt the flow of the drilling fluid 20 through the drill string 14 to cause pressure pulses or changes fluid flow. The pressure pulses are modulated by operation of the fluidic modulator and thereby encoded for telemetry purposes. For example in FIG. 1, fluidic modulator 200 is operated so as to create a pressure change in the drilling fluid in the wellbore and in the mud line 26 that is encoded with data for example from the downhole data source 36. The modulated changes in the pressure of the drilling fluid 20 may be detected by a pressure transducer 40 and a pump piston sensor 42, both of which may be coupled to a surface system processor, see for example processor 50 in FIG. 2. The surface system processor may interpret the modulated changes in the pressure of drilling fluid 20 to reconstruct the measurements, data and/or information collected and sent by the data source 36. The modulation and demodulation of a pressure wave are described in detail in commonly assigned U.S. Pat. Nos. 5,375,098 and 8,302,685, which are incorporated by reference herein in their entirety.

The surface system processor, as well as other processors, may be implemented using any desired combination of hardware and/or software. For example, a personal computer platform, workstation platform, etc. may store on a computer readable medium, for example, a magnetic or optical hard disk and/or random access memory and execute one or more software routines, programs, machine readable code and/or instructions to perform the operations described herein. Additionally or alternatively, the surface system processor may utilize dedicated hardware or logic such as, for example, application specific integrated circuits, configured programmable logic controllers, discrete logic, analog circuitry and/or passive electrical components to perform the functions or operations described herein.

The surface system processor may be positioned relatively proximate and/or adjacent to the drilling rig 10. In other words, the surface system processor may be substantially co-located with the drilling rig 10. Alternatively, a part of or the entire surface system processor may alternatively be located relatively remote with respect to the drilling rig 10. For example, the surface system processor may be operationally and/or communicatively coupled to the fluidic modulator 200 via any combination of one or more wireless or hardwired communication links. Such communication links may include communications links via a packet switched network (e.g., the Internet), hardwired telephone lines, cellular communication links and/or other radio frequency based communication links which may utilize any communication protocol.

Figure 2:
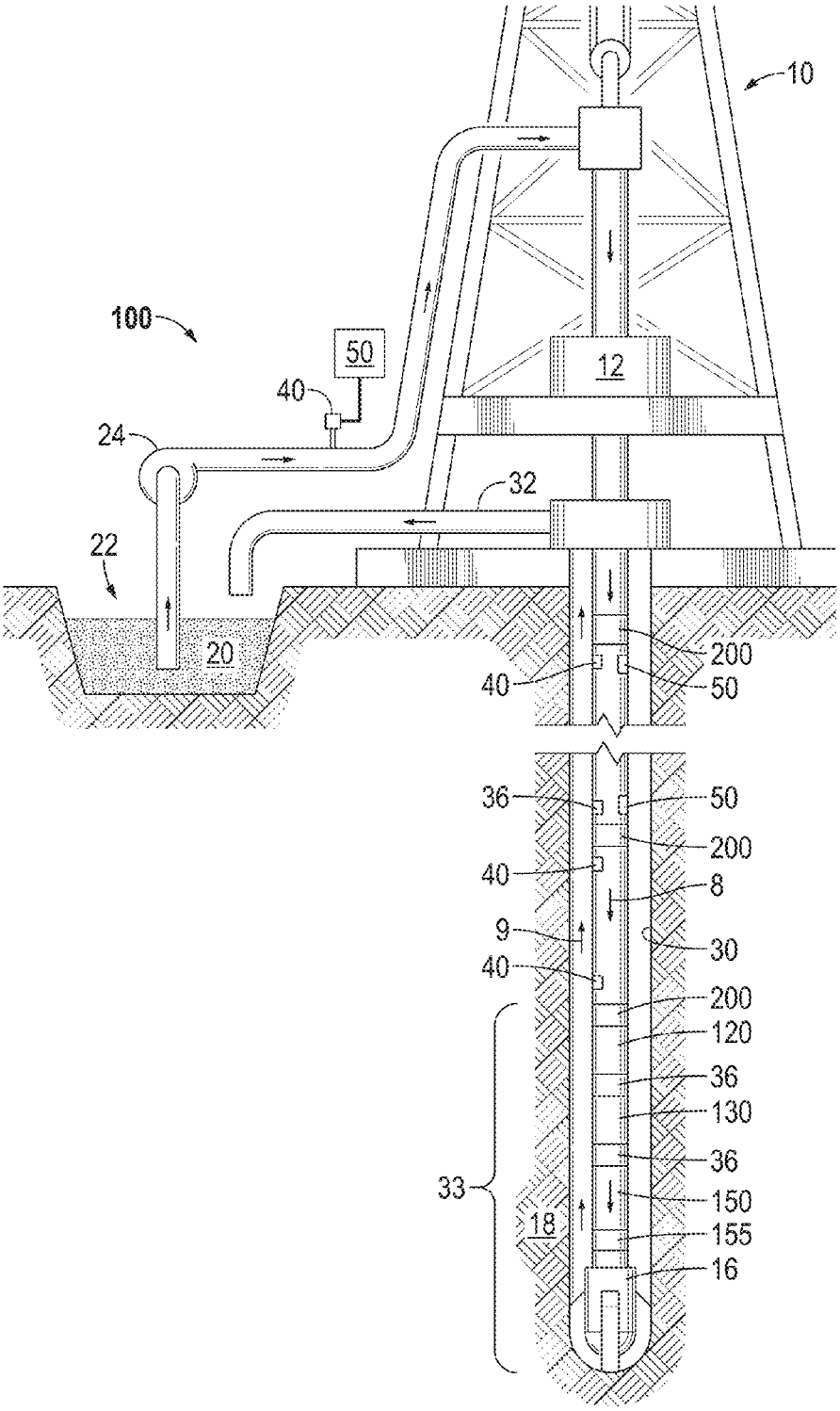

FIG. 2 illustrates a well or drilling system 100 in accordance to aspects of the disclosure in which embodiments of the fluidic modulator 200 can be employed. The borehole or wellbore 30 may be formed in subsurface formations 18 by rotary drilling using any suitable technique. Drill string 14 is suspended within the wellbore 30 and has a bottom hole assembly ("BHA") 33 that includes a drill bit 16 at its lower end. Pump 24 may deliver the drilling fluid 20 to the interior of the drill string 14 via a port in the swivel, causing the drilling fluid to flow downwardly through the drill string 14 as indicated by the directional arrow 8. The drilling fluid 20 may exit the drill string 14 via ports in the drill bit 16, and circulate upwardly through the annulus 28 region between the outside of the drill string 14 and the wall of the wellbore 30, as indicated by the directional arrows 9.

BHA 33 may include one or more downhole tools such as a logging-while-drilling ("LWD") tool 120 and/or a measuring-while-drilling ("MWD") tool 130, a motor 150 (e.g., mud motor), a rotary steering system ("RSS") 155 and drill bit 16. In accordance with some embodiments, mud motor 150 converts fluid power in the downward mud flow into rotary motion. The rotary motion is transmitted to the portions of the BHA below mud motor 150. In some embodiments, the mud motor 150 comprises a positive displacement motor ("PDM") or turbodrill. FIG. 2 illustrates a rotary steering system ("RSS") 155 connected below mud motor 150, but other types of equipment (e.g., measurement equipment or drill bit) may be connected below the mud motor. In addition, a BHA may include a bent housing or other directional drilling device. RSS 155 may include pads that are selectively actuated to steer the drill bit.

LWD tool 120 can be housed in a special type of drill collar, as is known in the art, and can contain one or more known types of logging tools. LWD tool 120 may include capabilities for measuring, processing and storing information, as well as for communicating with surface equipment. LWD tool 120 may be employed to obtain various downhole measurements as generally represented by one or more sensors (e.g., sensor assembly) identified generally as local or data source sensors 36.

MWD tool 130 can also be housed in a special type of drill collar, as is known in the art, and can contain one or more devices for measuring characteristics of the drill string and drill bit. It will also be understood that more than one MWD can be employed. MWD tool 130 may include capabilities for measuring, processing and storing information, as well as for communicating with surface equipment. MWD tool 130 may be employed to obtain various downhole measurements as generally represented by one or more sensors (e.g., sensor assembly) identified generally as data source sensors 36.

System 100 depicted in FIG. 2 includes more than one fluidic modulator 200 each of which may be utilized to modulate pressure pulses in the drilling fluid 20 to transmit data (e.g., control signals) downhole and/or to transmit downhole measurements to the surface. In accordance to aspects of the disclosure the flow path through the fluidic modulator 200 is co-axial with the flow path through the drill string. The modulated changes in the pressure (i.e., the signal) of the drilling fluid 20 may be detected at a pressure transducer 40 (i.e., sensor) and a processor (e.g., decoder, demodulator) generally identified by the numeral 50 interprets the modulated changes in the pressure of the drilling fluid 20 to reconstruct the signal sent by a fluidic modulator 200. The processor 50 may also encode data such that the fluidic modulator is actuated to modulate the pressure pulses to transit the encoded data. The modulation and demodulation of a pressure wave are described in detail in commonly assigned U.S. Pat. Nos. 5,375,098 and 8,302,685, the teachings of which are incorporated herein by reference.

Similar to the system depicted in FIG. 1, BHA 33 includes a fluidic modulator 200 to operate for example as an uplink for data and information obtained by downhole tools such as the LWD tool 120 and MWD tool 130. In accordance with some embodiments, fluidic modulators 200 may be located at intervals along the drill string and utilized as repeaters to receive the original signal and transmit the signal with renewed energy. In accordance to some embodiments, the drilling system may include one or more fluidic modulators 200 located at intervals along the length of the drill string to provide along the string measurements. For example, an original signal may be transmitted from the BHA fluidic modulator. The original signal may be received at a pressure transducer 40 located uphole and associated with a second uphole fluidic modulator 200. The second fluidic modulator may transmit the original signal and include a signal encoded with well data obtained at a data source sensor 36 that is located uphole from the BHA. For example, data source sensor 36 may obtain measurements such as and without limitation to pressure, temperature, flow rate, fluid phase, fluid resistivity, fluid pH, fluid viscosity, fluid density, and fluid chemical composition. Accordingly, the fluidic modulator 200 may be utilized for uplink and downlink communications, as a repeater and as an along the drill string unit for providing along the string measurements ("ASM").

The fluidic modulator 200 (i.e., modulation mechanism) includes a flow path through which drilling fluid, i.e., mud, can flow. The flow path may include a venturi having a constricted flow aperture 216 or reduced flow path area, i.e. constriction or throat. The fluidic modulator includes a moveable portion or element 218, which can be operated to alter or disrupt the fluid flow through the constricted flow aperture for example by changing the size or cross-section area of the flow aperture or otherwise changing the resistance to the fluid flow through the flow aperture. The moveable element can be formed in various geometric shapes and configurations as will be understood with benefit of this disclosure. The movement of the moveable element for example radially relative to the inner wall of the throat or relative to the longitudinal axis of the fluidic modulator flow path changes the nominal diameter of the flow aperture. In accordance to one or more aspects the moveable element may be rotated in the flow aperture to change the cross-sectional surface area of the moveable element that is blocking the flow aperture. For example, a moveable element may have two sides or faces having different cross-sectional surface areas. Rotating the moveable element from a first face being positioned in the flow aperture perpendicular to the direction of the fluid flow to a second face being positioned in the flow aperture perpendicular to the fluid flow may increase or may decrease the cross-sectional area of the flow aperture that is open for fluid flow. In accordance to an aspect of at least one embodiment, a moveable element moves in response to the fluid flow and controlling the moveable elements resistance to movement alters the resistance to the fluid flow through the flow aperture thereby creating pressure pulses.

It should be recognized that the movement of the moveable element may not reduce the cross-sectional area of the flow aperture but instead increase the cross-section area for example when the moveable element is moved radially outward from the flow path thereby increasing the flow path area relative to the nominal flow path area or when a moveable element is rotated from a first face to a second face having a smaller blocking surface area than the first face. Accordingly, movement of the moveable element may be said to change or alter the flow aperture for example by increasing or decreasing the area (e.g. cross-sectional area) of the flow aperture (i.e. throat, constriction), altering the course of the fluid flow through the flow aperture, changing the texture of the wall forming the flow aperture, or otherwise disturbing the boundary layer of the fluid flow through the fluidic modulator.

Figure 3:
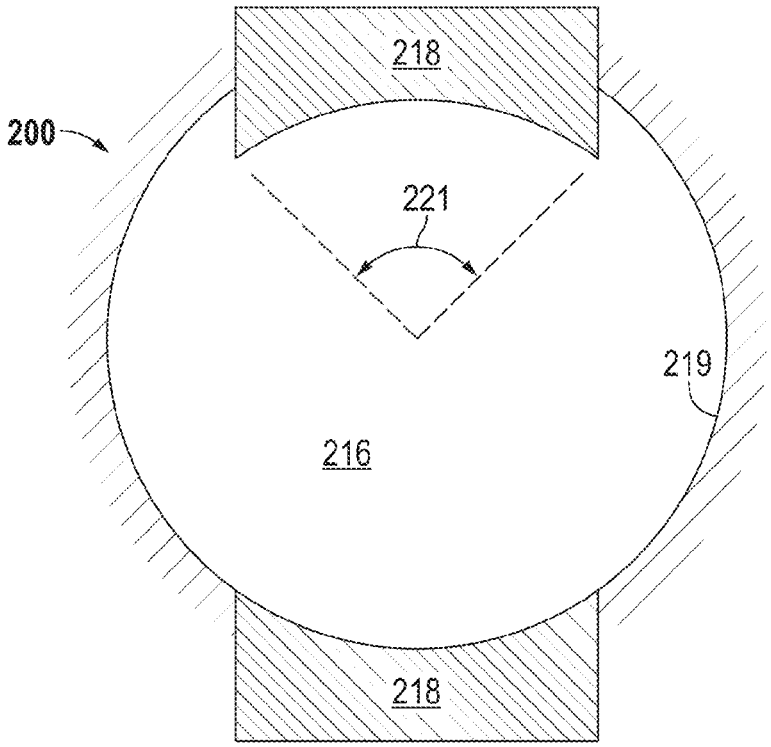
FIG. 3 is a schematic illustration of a fluidic modulator including more than one moveable portion and each moveable portion having a geometric shape covering a circumferential portion of a flow aperture of a fluidic modulator in accordance to aspects of the disclosure.

FIG. 3 is a schematic illustration of a fluidic modulator 200 with more than one moveable portion 216 operationally positioned at the constricted flow aperture 216. Each of the moveable portions or elements 218 may be configured to cover a selected percentage or portion of the circumference of the flow aperture when it is an operational or closed position. For example, moveable element 218 may be configured so that when it is extended into the flow path area of flow aperture 216 a selected percentage of the 360 degree circumference of the flow aperture is covered or blocked by the extended moveable element. For example, in FIG. 3 the top moveable element is configured to have a circumferential coverage indicated by the angle 221. This circumferential coverage 221 (i.e., arc angle or distance, central angle) may or may not vary with the radial distance that the top moveable element 218 extends from the inner wall 219 into the flow aperture. In other words, if the top moveable element is extended a second radial depth, e.g. greater than the illustrated first radial depth, into the flow aperture the circumferential coverage of the moveable element may remain the same in or the circumferential coverage may change. In FIG. 3, the top moveable element 218 is configured to have a constant circumferential coverage angle 221 without regard to the radial distance that it extends from inner wall 219 into the throat. It is noted that the blocking surface area of the face of the moveable element will increase as the moveable element is moved radially into the flow path although the circumferential coverage may remain the same.

In a different configuration, such as a circular shaped moveable element 218 the circumferential coverage angle 221 can vary with the radial distance it is extended into the throat or flow aperture 216. In accordance to various aspects, moveable element 218 may be rotationally or linearly translated in and out of the flow aperture of the fluidic modulator. For example, the moveable element may be in a circular shape and be linearly translated into and out of the flow path; accordingly the circumferential coverage of the moveable element 218 will increase as it is translated into the flow path. Similarly, a moveable element 218 may be rotated radially into the flow aperture from the side or circumferentially rotated into the flow aperture in a manner such that the circumferential coverage changes. In accordance to some aspects, the moveable element 218 may be positioned in the flow aperture and rotatable to position different faces of the moveable element that have different surface areas perpendicular to the direction of the fluid flow.

By way of example, top moveable element 218 is illustrated in FIG. 3 having a circumferential coverage of about 90 degrees; however, other circumferential coverages may be utilized without departing from the disclosure. For example, the circumferential coverage may be a minor arc, major arc, a semi-circle, or a full 360 degrees. Accordingly, the pressure drop in the fluid flow can be manipulated via the portion of the circumference of the flow aperture that is covered by the moveable element and/or the radial distance that the moveable element is extended from the inner wall into the flow path of the throat. The circumferential coverage and the radial extension in combination create the moveable element's blocking surface area that reduces the cross-sectional flow path area of the throat. As depicted in FIG. 3, the disclosed fluidic modulators may include one or more moveable elements 218 which can be operated independent of one another to provide a range of modulation control. In FIG. 3 a first moveable portion 218 is positioned in the flow aperture 216 and a second moveable portion 218 is actuated to a full open position removed from the flow aperture.

Figure 4:
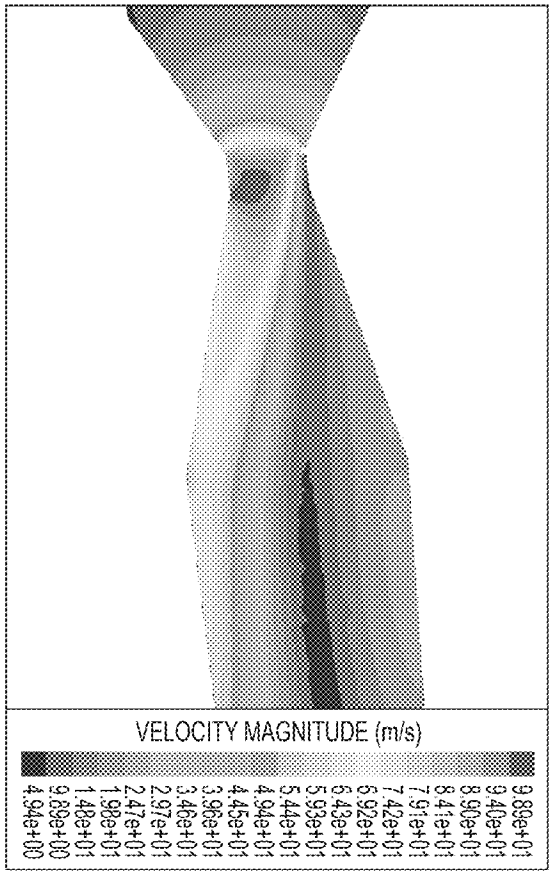
FIGS. 4 and 5 illustrate contours of velocity magnitudes of fluid modulators in accordance to aspects of the disclosure.

The pressure drop in the fluid flow may be caused by a combination of the choking effect of the movable element and the disruption of the fluid boundary layer in the exit funnel or diffuser of the fluidic modulator. Depending on the blocking surface area of the disposed movable element and/or the distance the moveable element is projected into or out of the flow aperture, the pressure drop may be caused mostly, if not entirely, by the boundary layer disruption. FIG. 4 illustrates changes in velocity and pressure fields through a fluidic modulator.

By utilizing a movable element that extends into only a fraction of the fluidic modulator flow path, the likelihood of jamming the fluidic modulator is reduced, if not eliminated. For example, poppet and mud siren types of mud pulse devices have a blocking element that remains positioned in the flow path of the amplifying device and of the drill string. In addition, fishing operations may be performed, for example by moving the moveable element out of the flow path. If necessary, the moveable element can be broken off or pushed out of the flow path when necessary fishing operations are performed.

Figure 20:
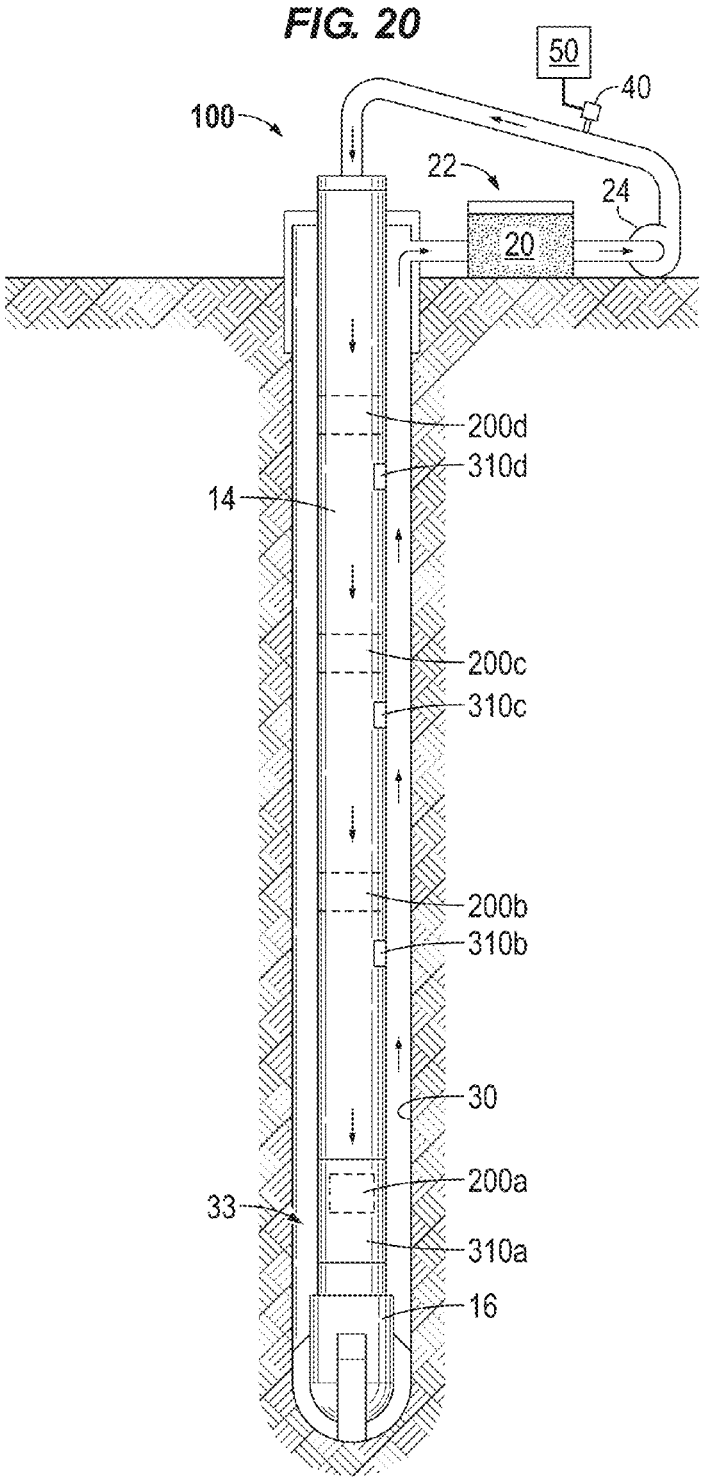

In conjunction with the fluidic modulator, upstream and downstream pressure sensors can be positioned to monitor the signal amplitude, see e.g. FIGS. 2 and 20. Based upon the received amplitude magnitude or strength, the location of the movable element can be adjusted to apply the desired amplitude magnitude. For example, the amplitude strength of the fluidic modulator may be increased as the drill string and the downhole fluidic modulator progresses away from the surface toward the total depth (TD). In accordance to aspects of the disclosure, a fluidic modulator may be operated to create a first pressure drop, for example 150 psi, to communicate with the surface when the fluidic modulator is located at a first depth, for example 2,500 feet from the surface. The fluidic modulator may be controlled to utilize a second higher pressure drop, for example about 400 psi, when the fluidic modulator is located at the total depth. In accordance to some aspects the amplitude strength may be changed while the fluidic modulator is located downhole and without requiring that the fluidic modulator be pulled out of the hole to change the amplitude strength. Additionally, the fluidic modulator may provide control of the shape of the pressure wave over time, providing increased bit rate communication.

To allow for erosion of the movable element, the movable element can be configured to have an extended length so that, as the distal end of the movable element is eroded, the additional length of the movable element can be utilized to extend the overall life of the fluidic modulator. This technique can be used to improve signal strength at greater depths, by using a short length at shallow depths and a longer length at greater depths. In general, the length could be modified by downlink commands from the surface or an automated algorithm downhole. Redundant moveable elements, e.g., faces or tabs, may also be utilized to address erosion and/or for additional amplitude control, e.g. dynamic length or gap control.

Figure 5:
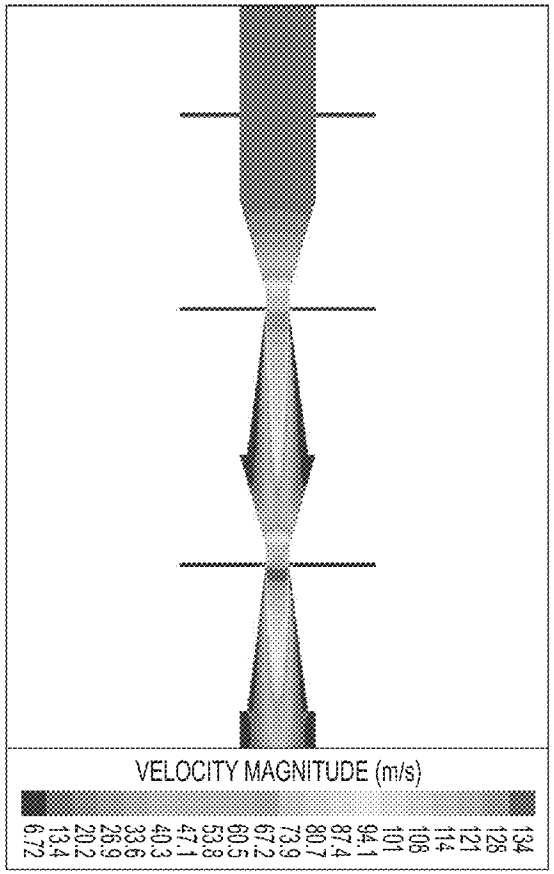

Some systems may include a multi-stage type of venturi, where several fluidic modulators are placed back to back in order to achieve a large pressure drop without requiring an extremely small diameter constriction. FIG. 5 illustrates an example of changes in velocity and pressure fields in a system utilizing fluidic modulators positioned in series. Two or more fluidic modulators in series may be applicable for example for use as a mid-string repeater, which could have a minimum inside diameter that is large enough to allow fishing operations. A multi-stage configuration may also reduce erosion as peak flow velocity is reduced.

Fluidic modulator 200 itself reflects tube waves in general and can be made to have different reflection coefficients in each direction, thus providing noise isolation between the surface, where the pressure transducers are located, and the BHA elements that are below the fluidic modulator (e.g., mud motors, active reamers, vibrating tools), see for example FIGS. 4 and 5. A fluidic modulator 200 downlink at the surface can reduce mud pump noise. Surface and BHA fluidic modulators in combination can reduce the noise environment in the middle of the wellbore (e.g., along the drill string) and provide a quiet medium to increase the bit rate of the signals. In accordance to aspects, the fluidic modulator can isolate noise sources from receivers (e.g., pressure transducers) and/or from other data source sensors.

Movement of the moveable element to block portions of the flow aperture may result in the generation of pressure waves with fast rise times, such as a few milliseconds. The resulting reaction force on the structure anchoring the fluidic modulator, such as the drill string, can impart vibration to the BHA. The vibration may be used to reduce or resist differential sticking and may be utilized for wellbore cleaning, increased rate of penetration and for other drilling optimization techniques.

The fluidic modulator can be used in many different applications, including uplink transmitters, mid-string repeaters, along-string communications, along-string measurements, lost circulation material ("LCM") tolerant/fail safe pulsers, downlinks, subsurface seismic exploration systems, and in high temperature applications (e.g., low power actuator). Other applications include without limitation as an agitator to shake the BHA for example to prevent sticking, as a hammer drill device for example with a PDC bit, and as an actuator to shift a piston or sleeve in response to a pressure differential. For example, fluidic modulators 200 may be utilized to actuate the rotary steering system (i.e., bias unit) 155 in FIG. 2.

Figure 6:
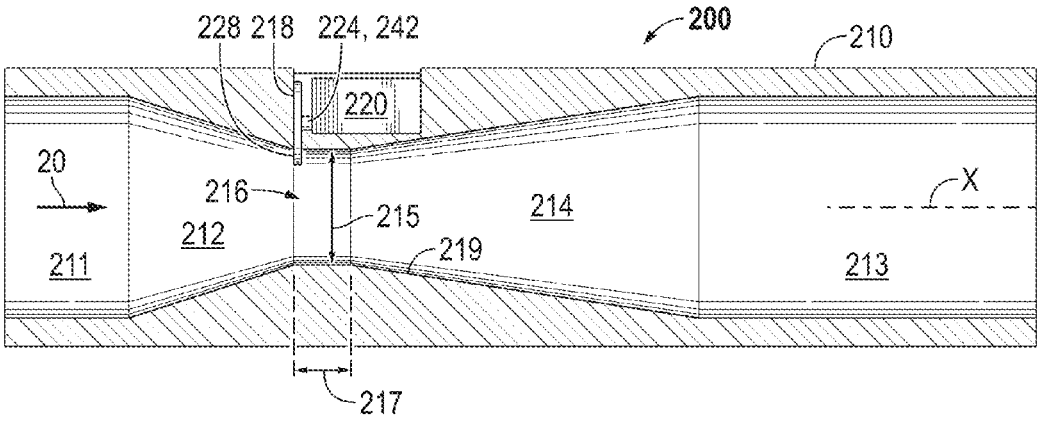
FIGS. 6-19 illustrate fluid modulators in accordance to aspects of the disclosure.

FIG. 6 schematically illustrates a sectional view of a non-limiting example of a fluidic modulator 200. Fluidic modulator 200 includes a housing or body 210 providing fluid flow path through which pressurized fluid 20, e.g., drilling fluid, mud, etc., flows. The fluid flow path comprises a constriction or flow aperture 216 coupling an inlet 211 and an outlet 213. Flow aperture 216 has a reduced diameter or cross-sectional area relative to the diameters or cross-sectional areas of inlet 211 and outlet 213. Constriction or flow aperture 216 has a nominal diameter 215 and a length 217. In accordance to aspects of some embodiments, a converging portion 212 narrows down from the diameter of inlet 211 to the diameter 215 of constriction 216 and an exit funnel or diffuser 214 tapers out from diameter 215 of flow aperture 216 to the larger diameter of outlet 213. The housing and/or flow constriction includes without limitation venturies, nozzles (e.g. shaped nozzles), and orifices (e.g., sharp edged orifices). The fluidic modulator may include one or more constrictions or flow apertures 216, i.e. throats, see for example FIG. 5, and or one or more moveable element blocking surfaces or faces.

Fluidic modulator 200 includes a moveable portion or element 218 (e.g. modulator, tab, tip) that can alter the size of the flow constriction or flow aperture 216 and/or to disrupt the boundary layer and create an amplified pressure drop in the flow aperture 216. The pressure drop can be modulated, and thus encoded for telemetry purposes, by selectively controlling movement of the moveable element 218 relative to the diameter or cross-sectional area of the constriction or flow aperture. The destabilized fluid flow does not recover before entering the diffuser 214. The destabilized fluid flow does not efficiently recover the created amplified pressure drop in the diffuser 214 consequently creating an amplified pressure drop between the inlet 211 and the outlet 213.

Depicted moveable element 218 is connected to a drive mechanism 220 (e.g., actuator, solenoid, controller, motor, brake) that moves and/or controls movement of movable element to induce changes in the flow aperture or changes to the resistance to fluid flow through the flow aperture. A change in the flow aperture may be an increase or a decrease in the cross-sectional area of the flow aperture, a change in the texture (i.e. friction) of the wall of the flow aperture, and/or altering the fluid flow path or flow regime (e.g., turbulent, laminar) through the fluidic modulator. In FIG. 6 the moveable element 218 is oriented substantially perpendicular to the longitudinal axis "X" of the flow path of the fluidic modulator 200 and it is radially movable relative to the inside surface or inner wall 219 of the constriction or flow aperture 216. In FIG. 6, moveable element 218 is rotated, i.e. circumferentially rotated, into flow aperture 216 and the flow path of fluid 20 as opposed to being linearly translated into the flow path. Moveable element may be constructed of a various materials. In accordance to an embodiment, moveable element 218 may be constructed of diamond and/or have a diamond surface and be disposed through a diamond surface portion of body 210 and/or a diamond element of body 210.

In FIG. 6, the axis of rotation 242 of the depicted moveable element 218 is oriented substantially parallel to the longitudinal axis X such that the moveable element may be rotated such that a blocking surface or face, generally denoted by the numeral 228, is rotated from the circumference of the flow aperture into the flow path of the flow aperture 216. When a blocking surface or face 228 of a moveable element 218 is operationally positioned in flow aperture 216 it is oriented toward the inlet 211 and therefore oriented against or the direction of fluid flow 20 whereby the surface area of the blocking surface or face 228 reduces the cross-sectional area of flow aperture 216 and thereby increases the resistance to fluid flow 20 through the flow aperture. Blocking surface or face 228 of moveable element 218 is illustrated as being positioned substantially perpendicular to the direction of the fluid flow 20 in FIG. 6. As will be understood, the blocking surface or face 228 may be positioned in flow aperture 216 and oriented at a non-perpendicular angle to the direction of fluid flow 20. For example, face 228 may be tilted so as to be non-perpendicular to the inner wall of the flow aperture 216 and non-perpendicular to the direction of fluid flow 20.

Any known drive mechanism for shifting or controlling the movement of the movable element is contemplated, including the use of a hydraulic drive. Further, the movable element can be configured to minimize exposure of the drive mechanism to the drilling fluid, such as by the use of bellows or other structures. In accordance to some aspects, a diamond interface between the moveable element and the body may be provided to minimize the exposure of the drive mechanism to the particular in the drilling fluid. It is contemplated that the movable element and/or the drive mechanism can be made of active materials, such as Terfenol D, to eliminate moving parts. Other active materials, such as a ceramic stack (e.g. piezoelectric ceramic stack) and a dual opposed ceramic stack can be utilized to eliminate moving parts, reduce power consumption, and/or thermally compensate the device.

In accordance to aspects of the disclosure, a moveable element 218 may form a portion of flow aperture 216. For example, moveable element 218 may form a limited part of the circumferential inner wall 219 of the constriction or flow aperture 216 or may form a full circumferential portion or section of flow aperture 216. Accordingly, moveable element 218 may be expanded, rotated, moved radially or otherwise moved to change the size of flow aperture 216 for example from nominal diameter 215 to a reduced or an expanded diameter and thereby change the cross-sectional area of the flow aperture.

Fluidic modulator 200 may include multiple moveable elements 218 and/or multiple blocking surfaces or faces 228. In accordance to some embodiments the moveable elements may be separately and independently moveable, for example the moveable elements 218 may be connected to separate drive mechanisms. For example, one or more moveable elements 218 may be radially expanded or contracted while other elements 218 remain static or moved in an opposing expanded or contracted position. FIG. 3 illustrates for example the top moveable portion 218 disposed in the flow aperture 216 and the bottom moveable element 218 in a full open position. In accordance to some embodiments, multiple moveable elements 218 may be operationally connected to a single drive mechanism. In accordance to some embodiments, a moveable element may have two or more blocking surfaces or faces with the same or different characteristics, such as surface area and geometric shape.

A multiple moveable element fluidic modulator can provide signal modularity control and manipulation. For example, a first moveable element or blocking surface may be configured to have a surface area sized relative to the flow aperture cross-sectional area to create a first pressure drop that may be suited for communications at a first subsurface depth. A second moveable element or blocking surface may be configured to have a different surface area from the first blocking surface to create a second pressure drop that may be suited for communications at a second subsurface depth. In some embodiments, the two or more moveable elements may be operated in combination to create the desired pressure drop. Accordingly, the fluidic modulator can provide the needed pressure pulses for communication at different depths without having to remove the fluidic modulator from the wellbore to adjust the pulse magnitude. In accordance to an aspect of a method of operation, a pressure signal emitted from a downhole fluidic modulator may be received at a sensor and information regarding the strength of the received pressure signal may be fed-back to the fluid modulator so that the pressure pulse strength of the fluidic modulator can be adjusted.

Figure 7:
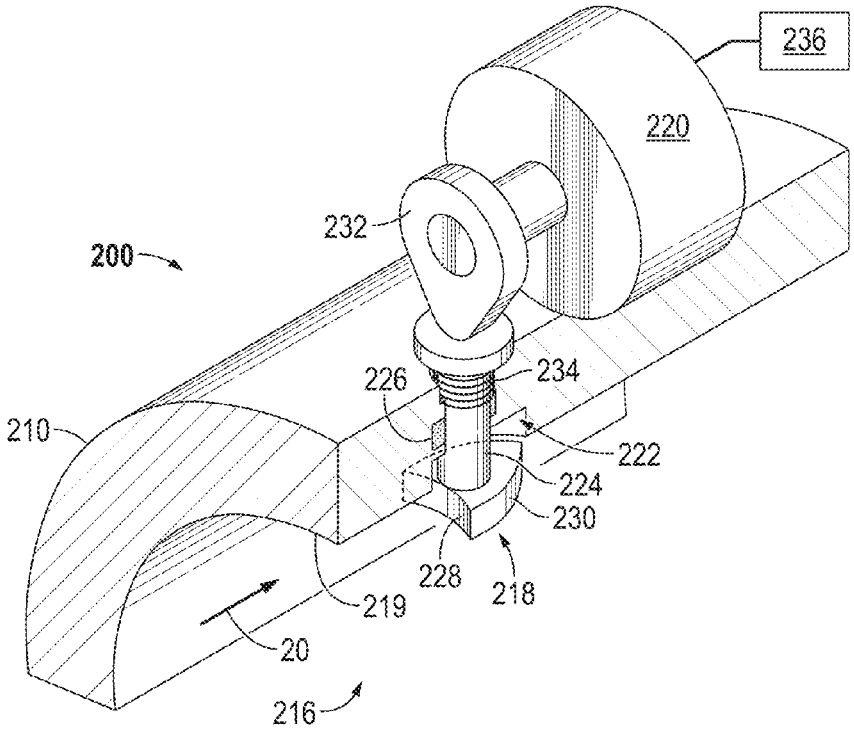

Refer now to FIG. 7 illustrating a moveable element 218 and fluidic modulator according to one or more aspects. The depicted moveable element 218 is moveable from a first position, for example an open position, wherein moveable element 218 is removed or substantially removed from the flow aperture to operational positions in the flow aperture. In FIG. 7, moveable element 218 may be removed from the flow aperture for example by being positioned in the illustrated recess or pocket 222 formed in inner wall 219 of the flow aperture. In accordance to an aspect of an embodiment, a portion of the blocking surface or face 228 may remain located in the flow aperture when the moveable element 218 is located in an open position.

The depicted moveable element 218 is radially and linearly translated in and out of the fluid flow path of flow aperture 216 by drive mechanism 220 via a shaft 224. In the illustrated example, shaft 224 extends through an outer bearing surface or sleeve 226 located in body 210. As further described below, the shaft 224 portion of the moveable element and the outer bearing surface may be constructed of diamond. In FIG. 7 the moveable element is oscillated along an axial or linear path as opposed to being rotated.

The geometric shape of moveable element 218, in particular the blocking surface or face 228, may be configured in various configurations and the illustrated and described geometric shape and configuration is one example. The geometric shape of the illustrated moveable element 218 has a slightly concave face 228 and an elongated and perhaps aerodynamic trailing edge or tail 230. This geometric shape of the moveable element may create a similar pressure change within the constriction or flow aperture as a result of disturbing and choking the fluid flow compared to other blocking surface profiles. The concave front blocking surface or face 228 may act to impart swirl and vortices into the fluid flow and disrupt boundary layers on the inner wall 219. The elongated tail 230 may improve the fluid dynamics around the moveable element to reduce erosion. The strength of the pressure pulse may be controlled by varying the distance that the moveable element is extended into flow aperture 216 from the inner wall. As previously noted, the moveable element 218 may be formed in various geometric shapes. In accordance to some embodiments, moveable element 218 may be circular shape (i.e. disc) that is linearly translated relative to the side wall of the flow aperture.

Drive mechanism 220 is illustrated connected to electronics 236 which may include for example, and without limitation, a power source, electronic circuits, a processor, memory, transducers (e.g. pressure transducer), and the like. Electronics 236 or similar electronics may be utilized with the fluidic modulators disclosed in the various figures. In operation, a signal can be communicated to modulator 200 to actuate and create a pressure pulse signal in the fluid 20; the modulator 200 may be actuated in response to a programmed event. In FIG. 7 the distance that blocking surface or face 228 is extended into flow aperture 216 can be controlled by the amount of rotation of cam 232. Accordingly the strength of the pressure pulse can be controlled by the radial distance that the moveable element is extended into the flow aperture. The amplitude can also be controlled for example by timed and/or repetitive in and out movement of the moveable element. In accordance to aspects of some embodiments, drive mechanism 220 may be or oriented or otherwise configured to linearly translate shaft 224 and/or moveable element 218 without using a cam as illustrated in FIG. 7.

In FIG. 7 moveable element 218 is constructed of tungsten carbide and is connected, e.g., shrink fit, onto diamond shaft 224 that will in turn act as a journal bearing with the outer bearing surface or sleeve 226. Moveable element 218 may be described as having a shaft portion 224 and a tab or tip end 244 carrying the blocking surface or face 228. The shaft portion and the tab or tip end 244 may be a unitary construction or constructed of two or more interconnected elements. The largest component in the moving assembly, shaft 224, is made of diamond rather than steel to obtain an inertial advantage. The fluidic modulator 200 in FIG. 7 includes a cam-follower system which is rarely used in downhole tools as the shock and vibration acts upon the unconstrained masses causing undesired motion. By reducing the mass of large components, as much as possible, the imparted inertia is minimized meaning that a spring loaded cam-follower is possible. The cam 232 and the spring 234 may act to restrict any undesired motion caused by shock and vibration, and as the mass has been decreased, the spring force required is less; hence less torque is required from drive mechanism 220. The elements of construction described with reference to FIG. 7 are examples, and different materials of construction and combinations of materials of construction and elements may be utilized without departing from scope of the disclosed fluidic modulator.

Diamond technology permits producing diamond approximately one inch in all directions, which limits the size of components that can be produced out of a single diamond piece. A reduced erosion geometric shape, such as illustrated in FIG. 7, facilitates the use of less erosion efficient materials than diamond. For example, the illustrated moveable element 218 may be constructed of a material such as tungsten carbide. Use of materials other than diamond permits forming larger moveable elements and a wider variety of profile shapes. Tungsten carbide has a thermal coefficient of expansion that facilitates its use in shrink fit assemblies. This allows a tungsten carbide moveable element, for example, to be shrink fitted onto a shaft or actuation mechanism to create a single component that does not rely on mechanical fittings in a critical area of flow.

Diamond can be manufactured to extremely tight tolerances such that two cylinders naturally act as a journal bearing. In FIG. 7, one or both of shaft 224 connecting the drive mechanism 220 to moveable element 218 and the sleeve 226, which acts as a bearing, comprise a diamond surface. This limits fluid and particle ingress into critical areas of the fluidic modulator and keeps friction on the shaft as low as possible thereby reducing the power needed to operate the fluidic modulator.

Figure 8:
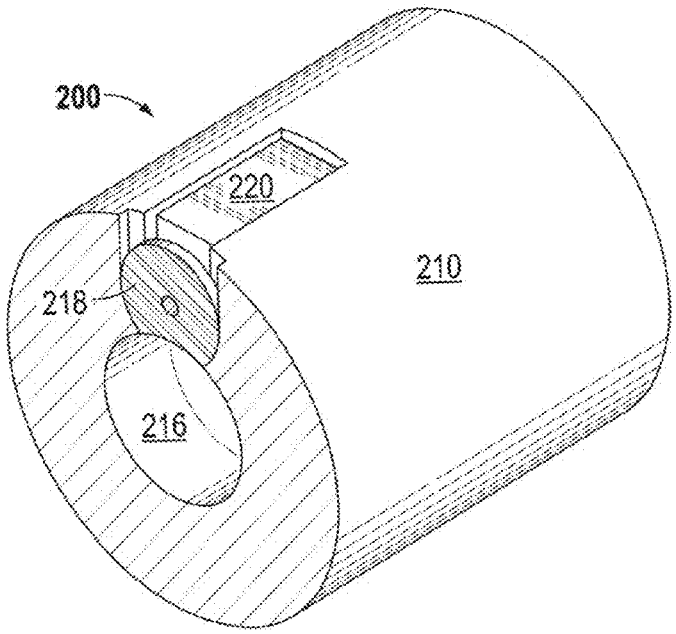
Figure 9:
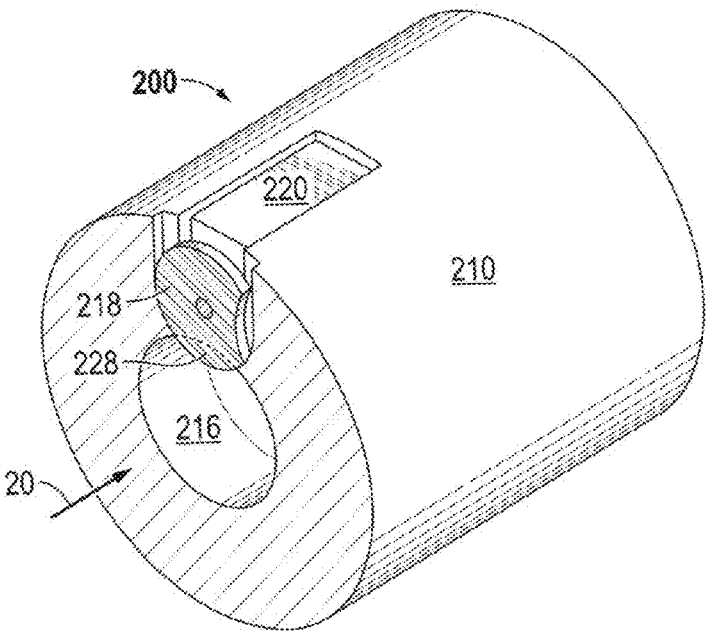

FIGS. 8 and 9 illustrate rotatable moveable elements 218, for example as illustrated in FIG. 6. In the illustrated examples, the moveable elements 218 may be rotated and oscillated to interrupt the fluid flow and/or boundary layer. For example, the moveable element 218 may be rotated to an open position as shown in FIG. 8 in which there is no obstruction or very limited obstruction to fluid flow, i.e. open flow channel. Similarly, in a closed position as illustrated in FIG. 9 the moveable element 218 obstructs the fluid flow through the flow aperture creating a pressure drop. The moveable element may be operated to obstruct various portions of the fluid flow to effect different pressure drops. It should be noted with reference to FIGS. 8 and 9 that the circumferential coverage 221 (FIG. 3) changes as moveable element 218 is rotated from the full open to the full closed position. Rotating the moveable element into the flow path at different speeds facilitates transmitting data.

The cross-sectional area of the flow aperture 216 is reduced by the portion of moveable element 218, i.e. the blocking surface or face 228 that extends into the flow aperture and blocks fluid flow through the flow aperture. It can be understood with reference to FIGS. 8 and 9 that the signal strength, i.e. pressure pulse amplitude, can be controlled by the surface area of the blocking surface or face 228 that is positioned in the flow aperture and oriented toward the inlet and the direction of the fluid flow. It can also be understood from FIGS. 8 and 9 that signal modulation may be controlled by oscillating or rotating moveable element 218 back and forth, thereby increasing and decreasing the flow path area of flow aperture 216.

Due to the size constraints inside a drill collar, i.e. housing or body 210, the larger the diameter of constriction or flow aperture 216 the smaller the moveable element 218 that can be used. For example, it is conceived that a 2.1 inch throat diameter is needed to pass a significant number of downhole tools and downhole pressure valve balls, for example for reamers, flow bypass subs, etc. Assuming a 6.75 inch tool outside diameter, signal strengths of 15-20 psi can be achieved from a single moveable element 218. In accordance to one or more aspects, signal strengths of 15-20 psi may be utilized in along-the-string measurement ("ASM") systems. Accordingly, the fluidic modulator can be utilized along the string.

The orientation of moveable element 218 may act to fill any gaps in the venturi throat walls. In an open position, see for example FIG. 8, the fluidic modulator would not be susceptible to jamming from loss circulation material or other large particles. Due to the low level of fluid distortion the pressure drop in this example may be maintained very low. This open position acts to allow items such as wireline tools, fishing tools, and back off strings to pass through the constricted flow aperture 216.

Figure 10:
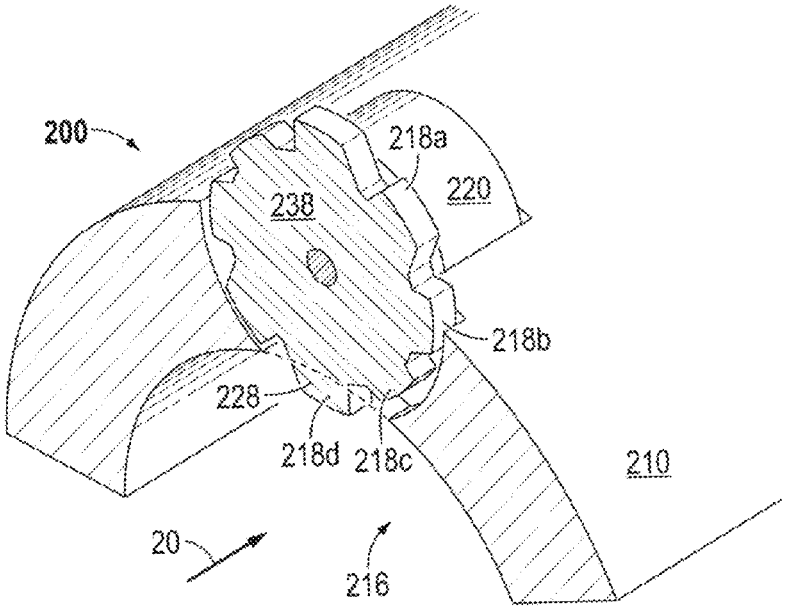
Figure 11:
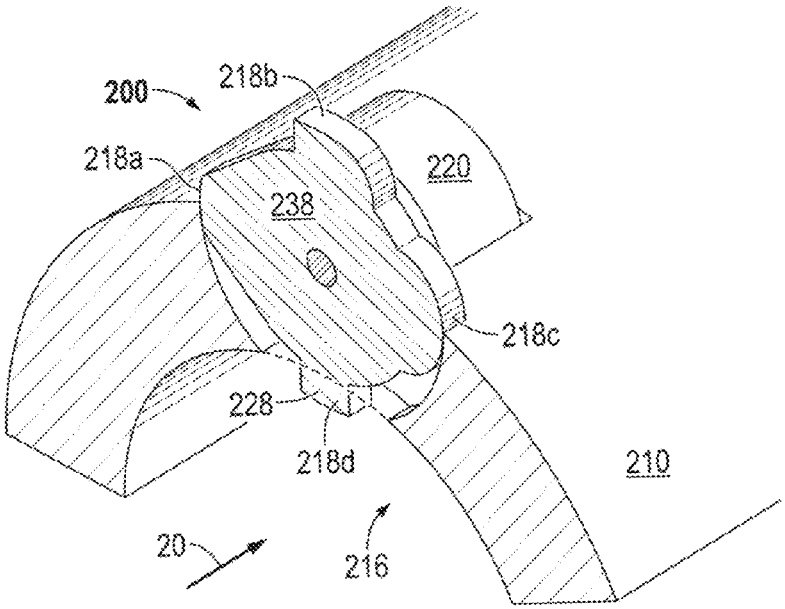

FIGS. 10 and 11 illustrate multiple moveable elements 218 located on a single moveable carrier member 238 or a single moveable member 238 having multiple blocking surfaces or faces 228. Depicted moveable member 238 is a circular disc that is rotationally connected to drive mechanism 220, e.g. motor, in the illustrated example. Moveable member 238 forms or provides two or more moveable elements generally identified with reference number 218 and specifically identified with reference numbers 218*a*, 218*b*, 218*c*, etc. The individual moveable elements 218 may have different dimensions of the respective blocking surface or face 228, i.e., surface area and/or geometric shape. One or more of the moveable elements may have substantially the same dimensions and geometric shape and provide redundancy and/or to provide for additional signal control. For example, the moveable member 238 may be operated in an oscillating motion to provide downhole amplitude and/or signal wave shape control. To increase the amplitude strength the disc or moveable member 238 can be indexed from a first moveable element 218 having a blocking surface or face 228 with a first surface area to a second moveable element having a blocking surface or face 228 with a second surface area larger than that of the first moveable element.

Conversely to decrease the signal amplitude the moveable member 238 can be indexed to position a smaller blocking surface area moveable element into the fluid flow path of the flow aperture. The individual moveable elements may have different geometric shapes, meaning the signal pressure wave can be adjusted for example to a square wave, sinusoid, etc. This allows for operating in multiple telemetry modes.

Figure 12:
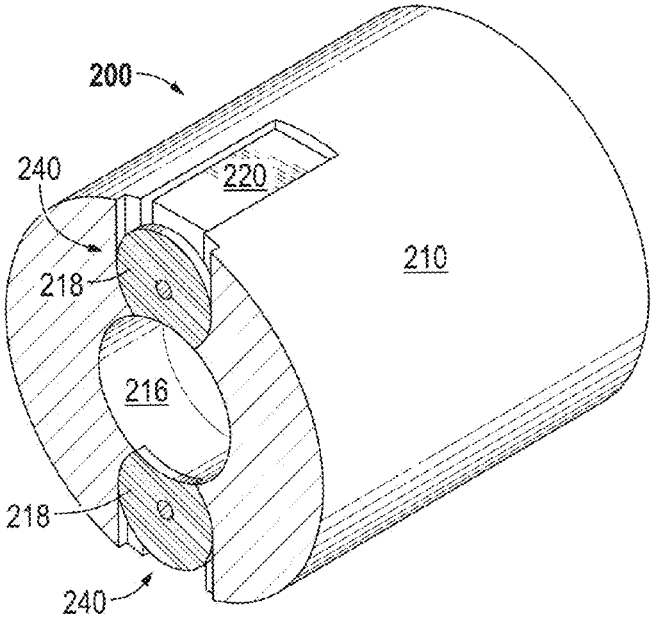
Figure 13:
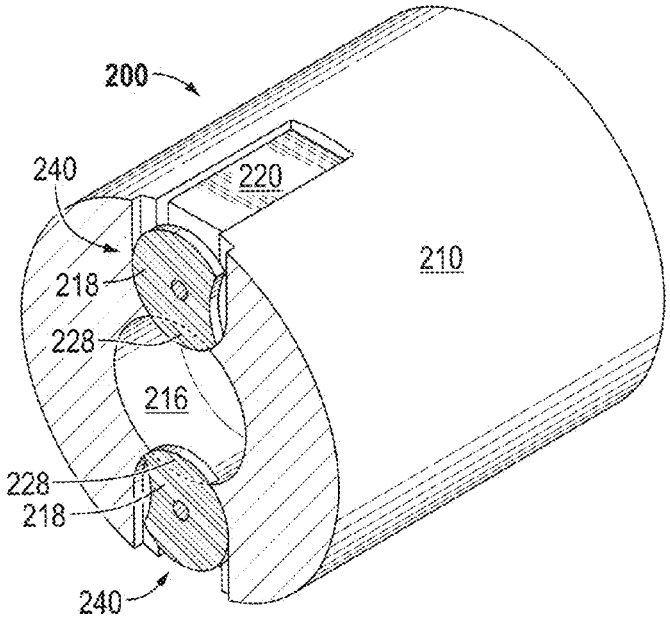

As noted previously, more than one moveable element may be positioned in the flow aperture simultaneously. For example, FIGS. 12 and 13 illustrate a fluidic modulator 200 utilizing two moveable element assemblies 240. Each of the depicted moveable element assemblies 240 includes a moveable element 218 operationally connected to a drive mechanism 220. In FIG. 12 the moveable element 218 of each of the assemblies 240 is located in the open position and FIG. 13 illustrates both moveable elements 218 in a closed position with a blocking surface or face 228 disposed in the flow aperture. In accordance to aspects, one moveable element 218 may be positioned in the flow aperture 216 while the other is removed from the flow aperture 216. The depicted moveable element assemblies 240 can be operated independently of one another. Accordingly, the multiple moveable element assemblies can be utilized for redundancy and/or amplitude control. One or both of the moveable element assemblies 240 may incorporate more than one moveable element 218 as illustrated for example in FIGS. 10 and 11. It will be recognized by those skilled in the art with benefit of this disclosure that two or more moveable elements may be located circumferentially about a single position (i.e., plane) of the flow aperture and/or spaced axially apart.

A multiple, e.g. twin, moveable element assembly configuration can provide for covering a larger percentage of the cross-sectional flow area of the flow aperture than a single moveable element assembly thereby permitting larger signal strengths while maintaining a flow aperture diameter that is large enough for passing other tools. The larger the flow aperture diameter the more wellbore applications and operations the fluidic modulator can be utilized. Additionally, the larger flow aperture diameter corresponds to lower fluid flow speeds which also results in improved erosion control.

Figure 14:
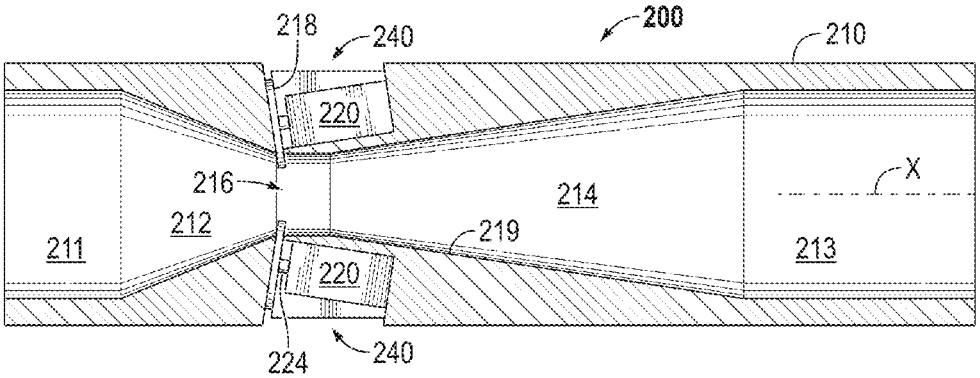

The moveable elements 218, i.e. blocking surface or face, may be tilted at a non-perpendicular angle to the longitudinal axis. For example, in FIG. 14 the moveable elements 218 are titled at a non-perpendicular angle to the longitudinal axis X. The moveable element 218 may be oriented such that the moveable element, for example the plane of the blocking surface or face, is substantially perpendicular to the inner wall 219 of diffuser 214. In this example, the shaft 224, i.e., the axis of rotation of the moveable element, that connects the rotatable moveable element 218 to the drive mechanism 220 is oriented substantially parallel with the inner wall 219 of diffuser 214 thereby orienting the moveable element and the blocking surface area or face at a non-perpendicular angle to the longitudinal axis of the flow path. The axis of rotation of moveable element 218 is substantially parallel with shaft 224 and substantially parallel to the inner wall 219 of diffuser 214.

The drive mechanism 220 and the electronics are located in the body 210 of the fluidic modulator (e.g., in a drill collar). The fluidic modulator electronics, e.g. electronics 236 in FIG. 7, may be located with the drive mechanism 220 or located in a wall portion of the drill string removed from the drive mechanism.

The tilt of the moveable element relative to the longitudinal axis may reduce the erosion of the moveable element. The tilt of the moveable element may also increase the signal strength relative to a moveable element oriented perpendicular to the longitudinal axis. The tilt of the moveable element away from perpendicular may alter the boundary layer.

Figure 15:
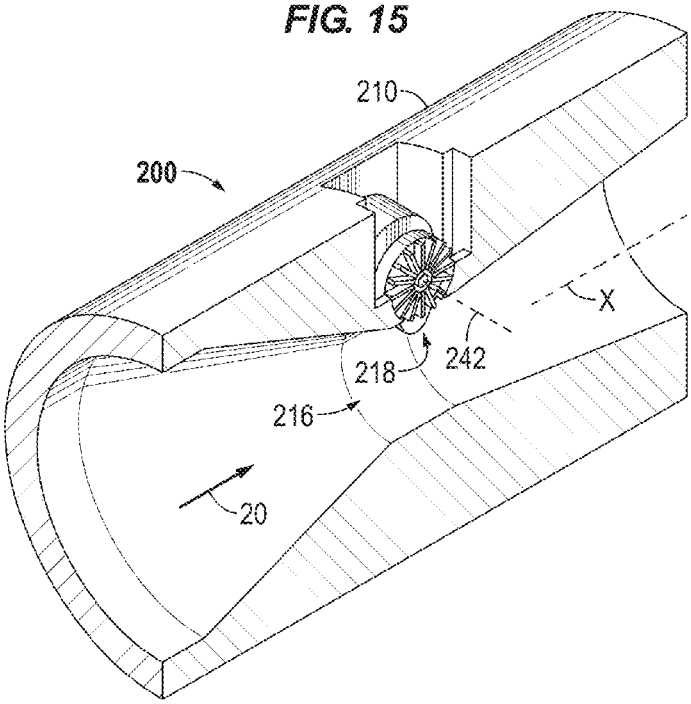

FIG. 15 illustrates an example of a plurality of moveable elements 218 arranged in a circular water wheel configuration about an axis of rotation 242 that is oriented perpendicular to the longitudinal axis X of the flow path. Accordingly, the moveable elements 218 are oriented so as to rotate in the direction of the fluid flow similar to a water wheel. This configuration may offer resistance to jamming and an option for the fluidic modulator (e.g., motor, brake, electronics, etc.) to power itself. In the event of blockage coming into contact with the moveable elements, the fluid 20 flow can push the obstruction through the flow aperture as the moveable elements rotate in the direction of the fluid flow.

Rotating the circular moveable element arrangement in the fluid flow direction may allow the fluid flow 20 to drive the circular moveable element arrangement. Drive mechanism 220 can provide less torque than in other configurations and the drive mechanism may apply braking torque rather than a drive torque. For example, a pressure signal pulse can be created by applying braking torque to the rotating moveable elements and changing the resistance to the fluid flow through the flow aperture. By controlling multiple rotating moveable element assemblies separately, additional amplitude control can be applied.

Figure 16:
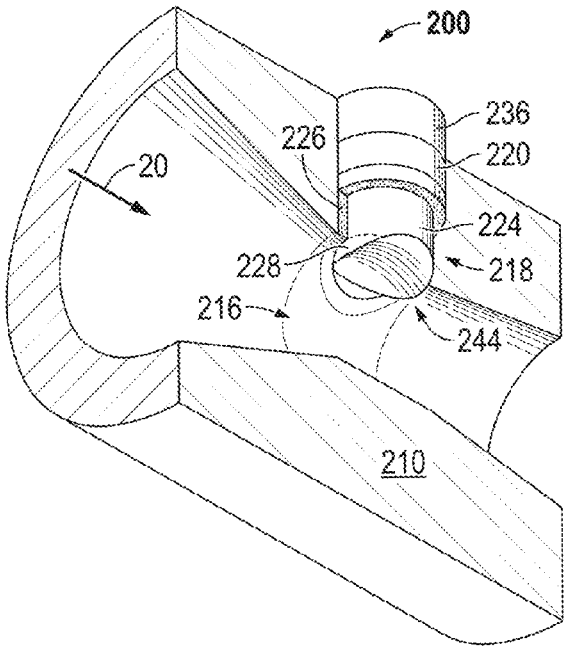
Figure 17:
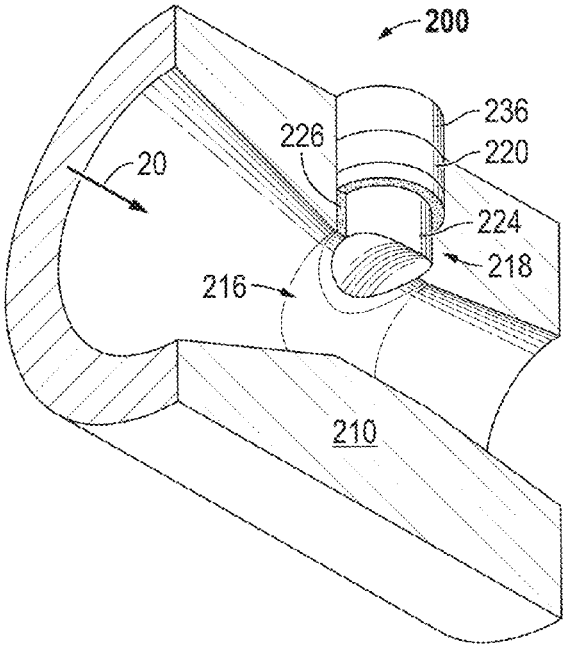

Refer now to FIGS. 16 and 17 illustrating a fluidic modulator 200 having a cylinder shaped moveable element 218 having at least one blocking surface or face 228 formed on a tip end 244 distal from the drive mechanism 220. Drive mechanism 220 rotates moveable element 218 between the closed position and the open position along the rotational axis of the cylinder shaped element.

FIG. 16 illustrates moveable element 218 rotated to a closed position with the blocking surface or face 228 positioned in flow aperture 216 and oriented toward the inlet and the direction of the fluid flow 20. FIG. 17 illustrates moveable element 218 rotated into a full open position. In FIGS. 16 and 17 the tip end 244 is an inverted U-shape or semi-circular shape such that in the full open position the moveable element is removed from flow aperture 216. For example, the contour of the tip end corresponds substantially with the curvature of flow aperture 216.

In FIGS. 16 and 17 the cylinder shaped moveable element 218, e.g., shaft 224, is disposed through an outer bearing surface or sleeve 226. In accordance to an embodiment, moveable element 218 and the outer bearing surface or sleeve 226 are constructed of diamond. The tight fit of the diamond components prevents or limits the particulates that can pass to drive mechanism 220 and electronics 236.

Figure 18:
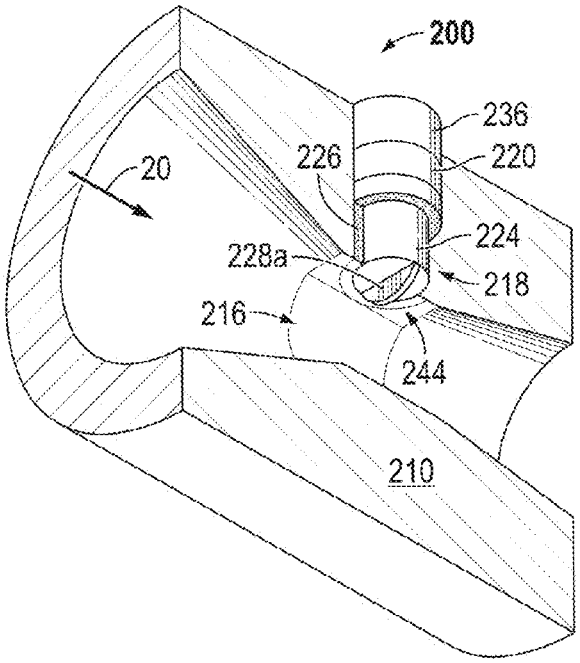
Figure 19:
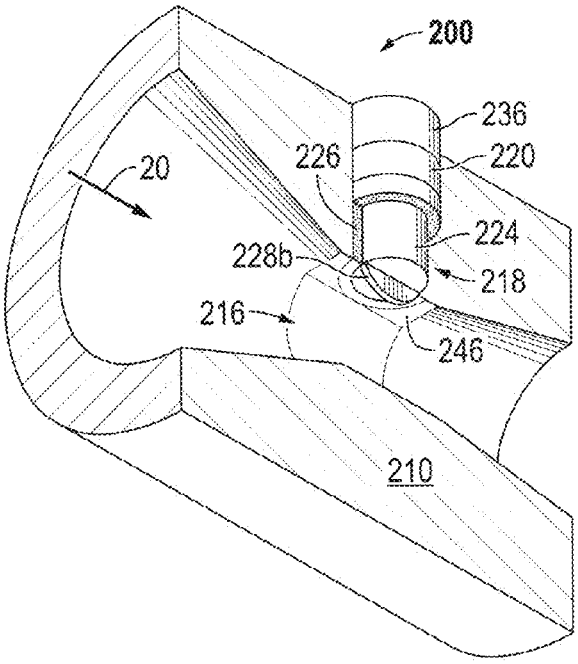

Refer now to FIGS. 18 and 19 illustrating a fluidic modulator 200 having a cylinder shaped moveable element 218 with a tab or tip end 244 carrying a closed blocking surface or face **228*a* and an open blocking surface or face 228*b*. Closed blocking surface or face 228*a* has larger surface area than open blocking surface or face 228*b*. Cylinder shaped moveable element 218 and tab or tip end 244 may be a unitary construction or constructed of two or more elements. For example, moveable element 218 may be constructed of diamond. In accordance to an aspect, the shaft portion 224 of moveable element 218 may be constructed of diamond and tab or tip end 244** is constructed of a different material such as tungsten carbide.

In FIG. 18 moveable element 218 is in the closed position with the closed blocking surface or face **228*a* located in flow aperture 216 and oriented toward the inlet and against the direction of fluid flow 20. In FIG. 19 the moveable element is rotated with the open blocking surface or face 228***b* in the flow aperture 216 and oriented toward the inlet and the fluid flow direction. In the open position of FIG. 19 the open blocking surface or face 228*b* remains positioned in the flow aperture 216. Tab or tip end 244 of the moveable element 218 is illustrated as being circular or semi-circular shaped along the open blocking surface or face 228*b* for example to minimize resistance to fluid flow 20 when in the open position.

In FIGS. 18 and 19 the tab or tip end 244 of moveable element 218 extends through a flattened surface or portion 246 of the inner wall of the flow aperture 216. In some embodiments the cylinder shaped moveable element 218 and the outer bearing surface or sleeve 226 are constructed of diamond.

As discussed previously, the mud pump noise and the reflected generated signal are attenuated as they pass through the fluidic modulator (e.g., venturi). In accordance to aspects of the disclosure, the fluidic modulator can be utilized as an along the string repeater and/or for along-the-string measurements ("ASM"). Fluidic modulators are located at intervals along the drill string, for example every 1,000 feet or so, as a repeater. In accordance to aspects the fluidic modulators may be located at different interval lengths as desired by an operator or as dictated by the well installation. For example, fluidic modulators may be separated by 250 feet or so in one wellbore and the fluidic modulators may be separated by 1,500 or more feet in a second wellbore. Similarly, the intervals between adjacent fluidic modulators may change within a single wellbore.

Sensors (e.g., data sources 36, pressure transducers 40) can be located along the drill string (FIG. 2), for example proximate to the fluidic modulator repeater stations, that can obtain local measurements which are transmitted with the original repeated, i.e. re-transmitted, signal to the next ASM repeater. In addition to the attenuation occurring at each fluidic modulator, the signal strength of the individual fluidic modulator repeaters may be established such that the signal will just make to it to the next ASM repeater. In this manner the repeaters can utilize the same carrier frequency. For example, adjacent fluidic modulator repeaters may use the same carrier frequency or the same carrier frequency may be repeated at every other fluidic modulator repeater. Accordingly, the attenuation of the signal by the fluidic modulator and the ability to control the signal strength may provide for isolation of the fluidic modulator repeaters reducing signal interference. The pressure signal strength may be changed in response to feedback information. For example, a pressure pulse from an uplink or repeater fluidic modulator may be received at a local sensor and information regarding the signal strength may be fed-back to the transmitting fluidic modulator so that the moveable element can be operated to increase or decrease strength of the pressure signal.

FIG. 20 is a schematic diagram of a well or drilling system 100 in which fluidic modulator 200 can be implemented and utilized. In this example, fluidic modulators, generally denoted with the numeral 200 and individually identified 200*a*, 200*b*, 200*c*, etc., are spaced intermittently along the tubular string that is disposed in the wellbore. The lower most fluidic modulator, specifically identified as 200*a*, may be located for example at the BHA 33. For purpose of illustration, each of the fluidic modulators is operationally connected to a sensor package, generally denoted by the numeral 310, and specifically identified 310*a*, 310*b*, etc. Each of the sensor packages may include for example a pressure transducer for receiving pressure pulse signals, and local data source sensors (e.g., data source sensors 36 in FIGS. 1 and 2). Data from the sensors and/or systems of the BHA (e.g., logging data, pressure, temperature, etc.) are encoded and the lower most modulator 200*a* is activated (i.e. operated) to transmit a pressure pulse containing the coded original data. The initial pressure pulse travels through drilling fluid 20 and is received at the second fluidic modulator 200*b*, for example at a pressure transducer generally depicted by the sensor package 310*b*. Fluidic modulator 200*b* can then retransmit the original data with additional local data that was measured and obtained for example by sensor package 310*b*. Additionally, information regarding for example the strength of the signal from fluidic modulator 200*a* may be fed-back to fluidic modulator 200*a* so that the signal strength can be increased or decreased by operating the moveable element to change the resistance to fluid flow through the flow aperture. The fluidic modulator electronics and/or an additional processor may code and decode the data. Fluidic modulator 200*a* can attenuate the noise of the drill bit and the drilling operations.

Fluidic modulator 200*b* may attenuate some or all of the signal strength of the original pressure pulse transmitted from modulator 200*a* to 200*b*. Fluidic modulator 200*b* may create the signal carrying pressure pulse at a different frequency than used from modulator 200*a* to 200*b*. The pressure pulse from modulator 200*b* is received at modulator 200*c* and is then retransmitted with additional data obtained by sensor package 310*c*. In accordance to some embodiments, modulator 200*c* may transmit at the same carrier frequency as modulator 200*a*. The process can continue transmitting the original data from the BHA and the measurements obtained at the along the string sensor packages 310*b*, 310*c*, 310*d*, etc. along the string, i.e. drill string 14.

In accordance to an aspect of the disclosure a well system includes a first fluidic modulator (FM) located at the bottom of the tubular string and a repeater fluidic modulator (FM) located in the tubular string between the first FM and the surface, the repeater FM including a body forming a flow aperture between an inlet and an outlet, the flow aperture providing a constriction to a fluid flowing axially through the tubular string, and a moveable portion operable to alter the flow aperture. To create a modulated pressure pulse the moveable portion may be for example radially shifted in the flow aperture, rotated in the flow aperture, or the rotation of the moveable portion in the flow aperture may be controlled. The repeater FM may communicate local data with the original data received from the first FM. In accordance to an aspect of a method a first fluidic modulator transmits a first pressure pulse which is received a repeater fluidic modulator which then transmits the original data in a second pressure pulse. The second pressure pulse may include local data in addition to the repeated data.

The foregoing outlines features of several embodiments so that those skilled in the art may better understand the aspects of the disclosure. Those skilled in the art should appreciate that they may readily use the disclosure as a basis for designing or modifying other processes and structures for carrying out the same purposes and/or achieving the same advantages of the embodiments introduced herein. Those skilled in the art should also realize that such equivalent constructions do not depart from the spirit and scope of the disclosure, and that they may make various changes, substitutions and alterations herein without departing from the spirit and scope of the disclosure. The scope of the invention should be determined only by the language of the claims that follow. The term "comprising" within the claims is intended to mean "including at least" such that the recited listing of elements in a claim are an open group. The terms "a," "an" and other singular terms are intended to include the plural forms thereof unless specifically excluded.

What is claimed is:

1. A fluidic modulator, comprising:

a body forming a flow aperture between an inlet and an outlet, the flow aperture having a nominal diameter less than a diameter of the inlet and a diameter of the outlet whereby the flow aperture provides a constriction to a fluid flowing axially from the inlet to the outlet; and a moveable element comprising a shaft portion disposed through the body and a tip end selectively positionable in the flow aperture to alter the flow aperture, the moveable element being operable to a full open position removing the tip end from the flow aperture.

2. The fluidic modulator of claim 1, wherein the shaft portion is disposed through a diamond bearing surface of the body.

3. The fluidic modulator of claim 1, wherein the shaft portion is constructed of diamond and the tip end is constructed of tungsten carbide.

4. The fluidic modulator of claim 1, wherein the tip end comprises a trailing tail end opposite a blocking face.

5. The fluidic modulator of claim 1, wherein the tip end comprises a closed blocking face having a surface area larger than a surface area of an open blocking face, wherein the moveable element is rotatable to selectively orient the closed blocking face and the open blocking face toward the inlet.

6. The fluidic modulator of claim 1, further comprising a drive mechanism connected to the shaft portion through a cam, the drive mechanism and the cam operable to linearly translate the moveable element.

7. The fluidic modulator of claim 6, wherein the shaft portion is constructed of diamond and the tip end is constructed of tungsten carbide.

8. The fluidic modulator of claim 6, wherein the moveable element is operable to a full open position removing the tip end from the flow aperture.

9. The fluidic modulator of claim 6, wherein:

the shaft portion is constructed of diamond;

the tip end comprises a blocking face; and the drive mechanism linearly translates the moveable element from a full open position with the tip end removed from the flow aperture to a position with the blocking face located in the flow aperture and oriented toward the inlet.

10. A method of using a fluidic modulator, the method comprising:

using a body forming a flow aperture between an inlet and an outlet, the flow aperture having a nominal diameter less than a diameter of the inlet and a diameter of the outlet whereby the flow aperture provides a constriction to a fluid flowing axially from the inlet to the outlet, and a moveable element comprising a shaft portion disposed through the body and a tip end selectively positionable in the flow aperture to alter the flow aperture, the moveable element being operable to a full open position removing the tip end from the flow aperture; and creating a pressure pulse.

11. The method of claim 10, wherein the creating a pressure pulse comprises positioning the tip end and thereby disturbing a boundary layer of the flowing fluid.

12. The method of claim 10, wherein the creating a pressure pulse comprises moving the moveable element and thereby changing a cross-sectional area of the flow aperture.

13. The method of claim 10, further comprising:

receiving the created pressure pulse;

providing signal strength information to the fluidic modulator regarding the received created pressure pulse; and creating a second pressure pulse from the fluidic modulator in response to the signal strength information.

14. The method of claim 10, wherein the tip end comprises a closed blocking face having a surface area larger than a surface area of an open blocking face, wherein the moveable element is rotatable to selectively orient the closed blocking face and the open blocking face toward the inlet.

15. The method of claim 10, further comprising a drive mechanism connected to the shaft portion through a cam, the drive mechanism and the cam operable to linearly translate the moveable element, wherein the creating the pressure pulse comprises linearly translating the moveable element.

16. The method of claim 10, further comprising using the fluidic modulator in a well system as at least one selected from an uplink modulator, a downlink modulator, a repeater modulator, and an along the string measurement modulator.

17. A fluidic modulator, comprising:

a body forming a flow aperture between an inlet and an outlet, the flow aperture having a nominal diameter less than a diameter of the inlet and a diameter of the outlet whereby the flow aperture provides a constriction to a fluid flowing axially from the inlet to the outlet;

a diamond bearing surface disposed in the body adjacent to the flow aperture; and a moveable element operable to alter the flow aperture, the moveable element disposed through the bearing surface, the moveable element being operable to a full open position whereby the moveable element is substantially removed from the flow aperture.

18. The fluidic modulator of claim 17, further comprising a drive mechanism connected to the moveable element and operable to linearly translate the moveable element through the diamond bearing surface or circumferentially rotate the moveable element through the diamond bearing surface.

* * * * *